US008893351B2

(12) United States Patent
Payson

(10) Patent No.: US 8,893,351 B2
(45) Date of Patent: Nov. 25, 2014

(54) RECIPROCALLY TELESCOPING DOOR STOP

(75) Inventor: James F. Payson, Loveland, CO (US)

(73) Assignee: Blue Chip Welding, LLC, Loveland, CO (US)

( * ) Notice: Subject to any disclaimer, the term of this patent is extended or adjusted under 35 U.S.C. 154(b) by 32 days.

(21) Appl. No.: 13/424,108

(22) Filed: Mar. 19, 2012

(65) Prior Publication Data

US 2013/0239365 A1 Sep. 19, 2013

(51) Int. Cl.
*E05F 5/08* (2006.01)

(52) U.S. Cl.
CPC ..... *E05F 5/08* (2013.01)
USPC ..... 16/85; 16/82

(58) Field of Classification Search
CPC ..... E05F 5/08; E05F 5/00; E05F 5/02; E05F 5/025; E05F 5/06; E05F 5/10
USPC ..... 16/82, 83, 85, 86 R, 86 A; 292/341.12
See application file for complete search history.

(56) References Cited

U.S. PATENT DOCUMENTS

| | | | | |
|---|---|---|---|---|
| 1,044,412 | A * | 11/1912 | Newton | 16/85 |
| 1,122,133 | A * | 12/1914 | Lawler | 16/85 |
| 1,218,197 | A * | 3/1917 | MacKinlay | 16/85 |
| 1,628,826 | A * | 5/1927 | Covalence | 16/85 |
| 2002/0170794 | A1 * | 11/2002 | Dubach | 188/381 |
| 2002/0174513 | A1 * | 11/2002 | Hodson | 16/85 |
| 2007/0271732 | A1 * | 11/2007 | Bantle et al. | 16/84 |
| 2009/0094789 | A1 * | 4/2009 | Bereznai | 16/84 |

* cited by examiner

*Primary Examiner* — Jeffrey O Brien
(74) *Attorney, Agent, or Firm* — Craig R. Miles; CR Miles, P.C.

(57) ABSTRACT

A door stop having a first member and a second member, the second member reciprocally telescopically engaged with said first member with a springing element responsive to the movement of the second member.

10 Claims, 6 Drawing Sheets

1
2B
2B
9
22
21
4
28/33
34
25
5/20
24
18
27
31
26
30
32
2A
2A
2/10
11
12
13
11
3/17
23

4

3

RECIPROCALLY TELESCOPING DOOR STOP

I. FIELD OF THE INVENTION

A door stop having a first member and a second member, the second member reciprocally telescopically engaged with said first member with a springing element responsive to the movement of the second member.

II. BACKGROUND OF THE INVENTION

Heavy doors and panels moving in a travel path in a space transfer a substantial amount of force when stopped. Conventional door stops of static configuration may lack adequate strength or may lack adequate securement to the supporting surface to effectively repeatedly stop heavy doors and panels without being damaged or coming unsecured from the support surface. Additionally, conventional door stops having static unyielding configuration when swingingly engaged by a heavy door or panel may cause damage to the door or may even injure persons due being abruptly stopped in the travel path.

The instant invention provides an inventive door stop which overcomes in whole or in part certain of the forgoing disadvantages of conventional door stops.

III. SUMMARY OF THE INVENTION

Accordingly, a broad object of embodiments of the invention can be to provide a door stop having first member and a second member reciprocally telescopically engaged to allow a springing element to compress in response to the telescoping movement of the second member upon stopping a moving door.

Another object of the invention of particular embodiments of the invention can be a method of producing a door stop having first member and a second member reciprocally telescopically engaged to allow a springing element to compress in response to the telescoping movement of the second member upon stopping a moving door.

Another broad object of the invention of particular embodiments of the invention can be a method of stopping a door by positioning an outwardly extending end of telescopically engaged members in the travel path of a door at a location which allows engagement of an outwardly extending end of telescopically engaged members with the door moving in a travel path thereby compressing a springing element responsive to inward telescoping movement of the outwardly extending end thereby absorbing the force of stopping the door.

Naturally, further objects of the invention are disclosed throughout other areas of the specification, drawings, photographs, and claims.

IV. BRIEF DESCRIPTION OF THE DRAWINGS

V. DETAILED DESCRIPTION OF THE INVENTION

Figure 1:
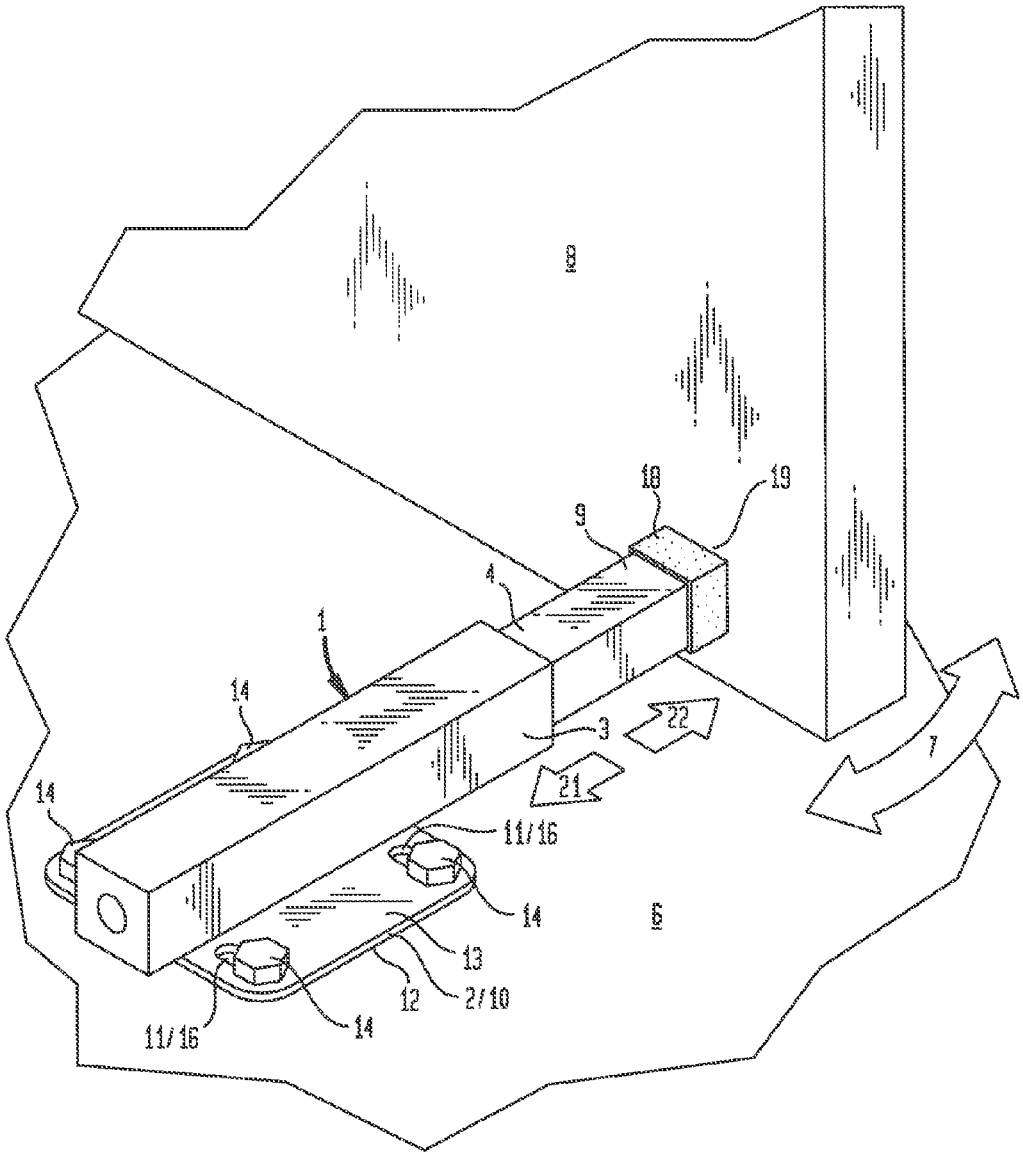
FIG. 1 is an illustration showing an embodiment of the inventive door stop secured at a location which allows engagement of an outwardly extending end of a reciprocally telescoping member with a door.
Figures 2, 2A, 2B:
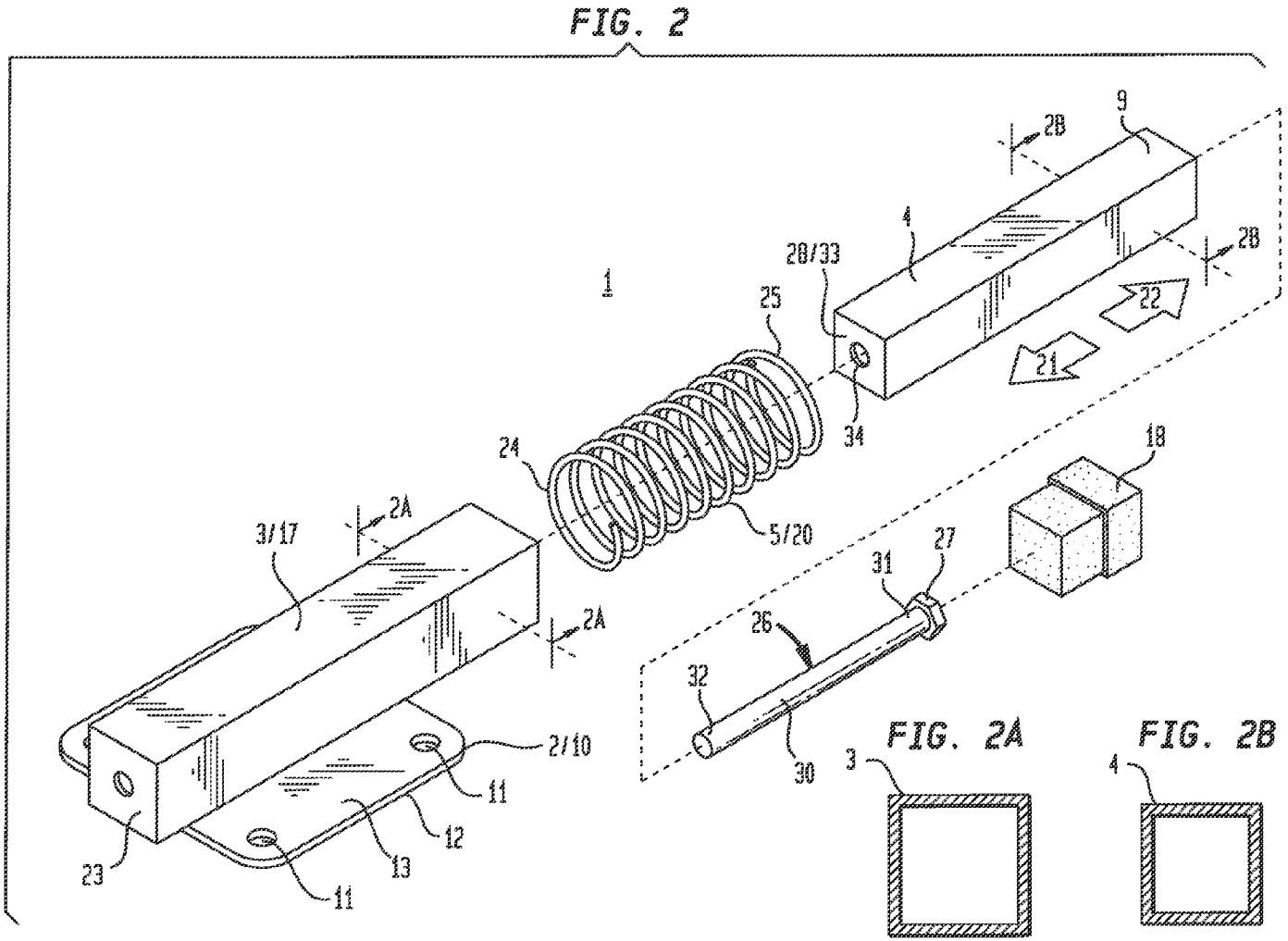
FIG. 2 is an exploded view of an embodiment of the inventive door stop.
FIG. 2A is cross section view 2A-2A shown in FIG. 2.
FIG. 2B is cross section view 2B-2B shown in FIG. 2.
Figure 3:
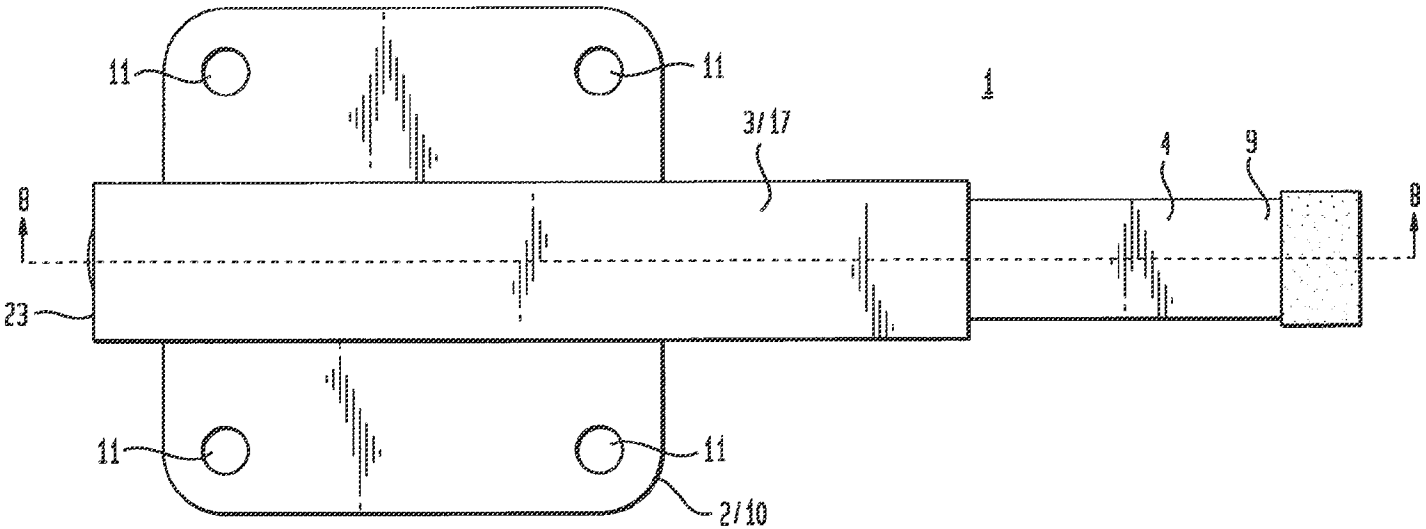
FIG. 3 is a top view of an embodiment of the inventive door stop.
Figure 4:
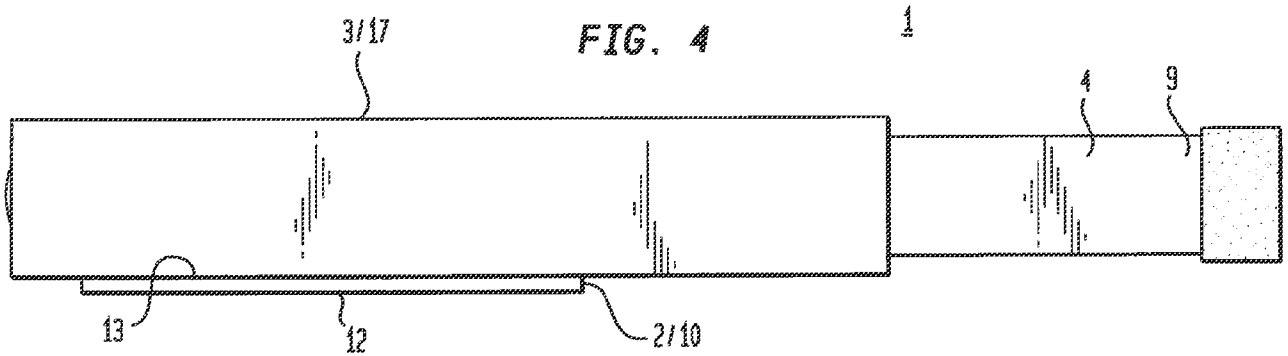
FIG. 4 is a side view of an embodiment of the inventive door stop.
Figure 5:
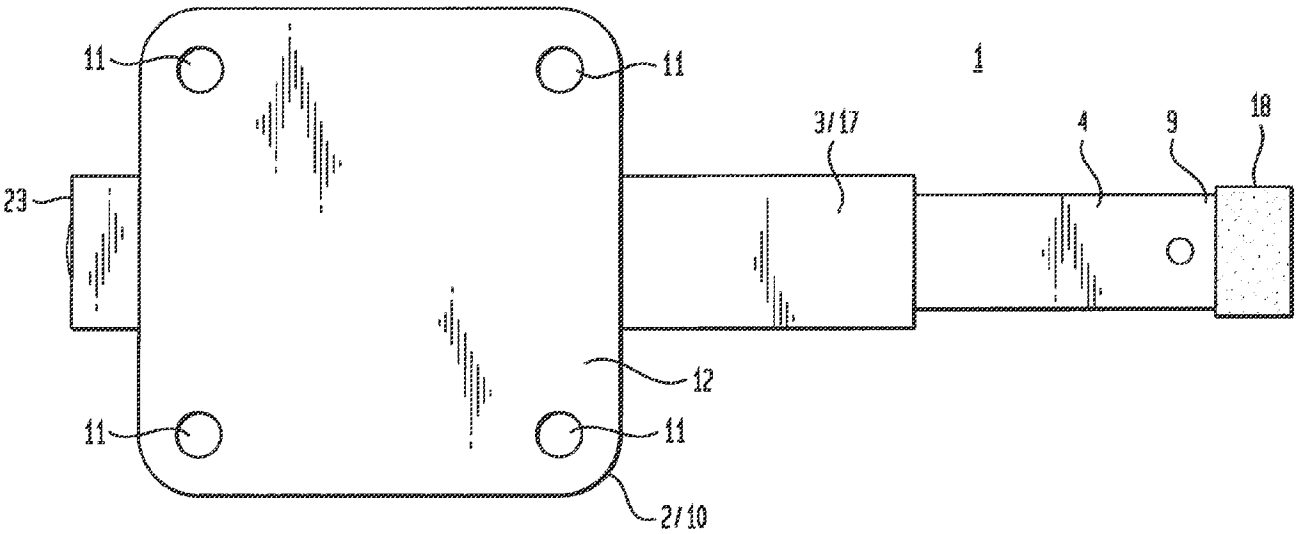
FIG. 5 is bottom view of an embodiment of the inventive door stop.
Figure 8:
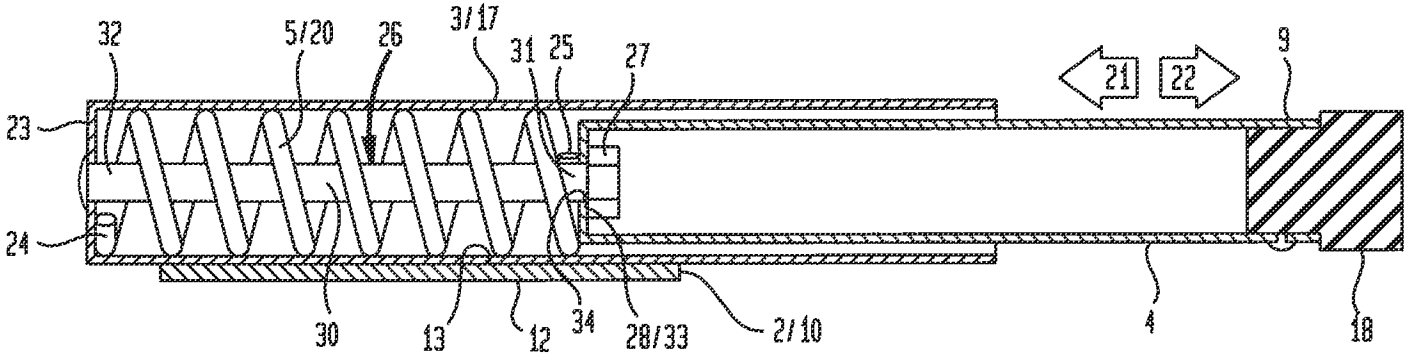
FIG. 8 is cross section view 8-8 of the embodiment of the inventive door stop shown in FIG. 3.

Now referring primarily to FIG. 1, a particular embodiment of the inventive door stop (1) can include a base (2), a first member (3) coupled to the base (2), a second member (4) reciprocally telescopically engaged with said first member (3), and a springing element (5) responsive to inward telescopic movement of said second member (4) (an example of a springing element (5) is shown in FIGS. 2 and 8). Embodiments of the base (2) secure to a support surface (6) to fix the first member (3) in a travel path (7) of a door (8). The second member (4) reciprocally telescopically engaged to the first member (3) provides an outwardly extending end (9) positioned to engage the door (8) moving in the travel path (7). Engagement of the door (8) with the outwardly extending end (9) of the second member (4) can generate inward telescoping movement (21) of the second member (4) in relation to the first member (3), thereby sufficiently compressing the springing element (5) to resist further movement of the door (8) (or panel or other constructional form) in the travel path (7). Subsequent extension of the springing element (5) can generate outward telescoping movement (22) in the second member (4) which can assist in generating corresponding travel in the door (8) away from the door stop (1).

The term "door stop" for the purposes of this invention encompasses embodiments useful in restricting the movement of a door (8) that swings on hinges (as shown in the example of FIG. 1), but also broadly encompasses embodiments useful in restricting the movement of panels other than doors (8) (or other constructional forms) that swing on hinges, slide, rotate, or otherwise more in a travel path (7) inside of a space.

Now referring primarily to FIGS. 2 through 9, embodiments of the base (2) can be configured for securement to a support surface (6) (as shown in the example of FIG. 1). Particular embodiments of the base (2) can be configured in the form of a substantially planar member (10) having a plurality of holes (11) (as shown in the example of FIG. 2) communicating between opposed faces (12) (13). Each of the plurality of holes (11) can receive a corresponding one of a plurality of fasteners (14) (as shown in the example of FIG. 1) which can operably secure a first one (12) of the opposed faces (12) (13) of the planar member (10) to the support surface (6) allowing a first member (3) to be coupled to the second one (13) of the opposed faces (12) (13). However, the invention is not limited to the particular embodiment shown in the Figures, and the term base for the purposes of this invention broadly encompasses embodiments having a configuration which can be secured to the support surface (6) in any manner, for example by embedding the base (2) in whole or in part into the support surface (6), adhering the base (2) to the support surface (6) by use of adhesive, or the like, or in any manner which further allows the first member (3) to be coupled to the base (2) in an orientation which allows reciprocal telescoping engagement of the second member (4). A particular embodiment, can include a base (2) of substantially planar material having a thickness in the range of about one-eight inch and about three-sixteenths inch with opposed faces (12) (13) of generally square configuration defined by sides each having a length in the range of about three inches to about six inches.

Figure 7:
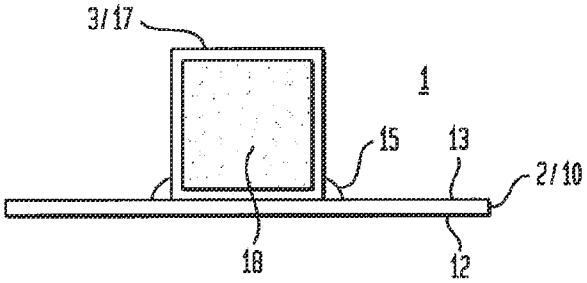
FIG. 7 is a second end view of an embodiment of the inventive door stop.
Figure 6:
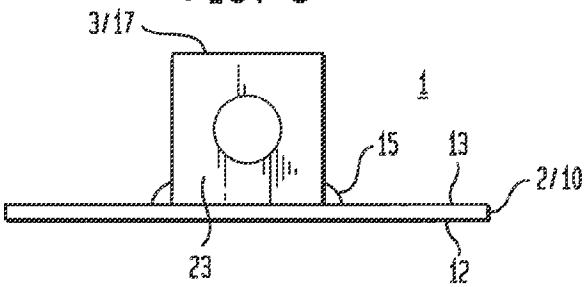
FIG. 6 is a first end view of an embodiment of the inventive door stop.

Again referring primarily to FIGS. 2 through 9, a first member (3) can be coupled to the base (2). The coupling can provide fixed relation between the base (2) and the first member (3), in the form of welding (15) (as shown in the example of FIGS. 6 and 7), adhesive or the like, or can provide adjustable fixed relation between the base (2) and the first member (3) in the form of a rotational coupling (16). The rotatable coupling (16) can be between the support surface (6) and a first one (12) of the opposed faces (12) (13) (as shown in the example of FIG. 1) or between the second one (13) of the opposed faces (12) (13) and the first member (3). Particular embodiments of the first member (3) can have a square or rectangular cross section (as shown in the example of FIG. 2A); however, embodiments of the invention can have any one of a wide variety of cross sectional forms including circular, oval, triangular, or the like. The first member (3) can be a solid, or as to certain embodiments, the first member (3) can include a tubular element (17) (as shown in the examples of FIGS. 1-9). The tubular element (17) can be configured to telescopically receive the second member (4). Particular embodiments can have a first member (3) produced from steel square tube each external side having width of in the range of about one inch to about one and one-half inch with a wall thickness of between about 14 gauge and about 17 gauge. Specific embodiments having sides of about one and one-quarter inch and a wall thickness of about one-sixteenth inch.

Again referring primarily to FIGS. 2 through 9, particular embodiment of the invention can include a second member (4) reciprocally telescopically engaged to the first member (3). As to certain embodiments, the second member (4) can be configured to be telescopically received inside of the tubular element (17) of the first member (3), as above described. Accordingly, the second member (4) can have an external surface configured in a wide variety of cross sectional forms corresponding to the wide variety of cross sectional forms of the first member (3) such as square, rectangular (as shown in the example of FIG. 2B), circular oval, or the like. As to particular embodiments, the first member (3) can be a solid form and the second member (4) can include the tubular element (17) such that the first member (3) is received inside of the tubular element (17) of the second member (4). The second member (4) reciprocally telescopically engaged in relation to the external surface of the first member (3). Now referring primarily to FIGS. 2 through 9, the second member (4) telescopically engaged with the first member (3) provides an outwardly extending end (9). The outwardly extending end (9) of the second member (4) can be have a fixed length determined in accordance with a particular application or can have an adjustable length to encompasses a wider variety of applications, as further described below. Particular embodiments can have a second member (4) produced from steel square tube each external side having width of in the range of about three-quarters inch to about one and one-quarter inch with a wall thickness of between about 14 gauge and about 17 gauge. Specific embodiments having sides of about one inch and a wall thickness of about one-sixteenth inch.

Particular embodiments of the base (2), the first member (3) and the second member (4) can be produced from metal plate and metal tubing; however, the invention is not so limited and the base (2), first member (3), and the second member (4) can be produced from a wide variety of materials such as plastic, thermoplastic reinforced fibers, or the like having sufficient strength for normal operation as above described. A protective coat can be applied to the external surf to protect the surfaces or to provide color. The protective coat can take the form of paint, powder coat, or the like.

Again referring primarily to FIGS. 2 through 9, particular embodiments of the invention can further include a elastically deformable terminal element (18) coupled to the outwardly extending end (9) of the second member (4). As to these embodiments, the elastically deformable terminal element (18) can engage the door (8) moving in the travel path (7). The elastically deformable terminal element (18) can be made from a sufficiently compressible or elastically deformable material, such as rubber, synthetic rubber, elastomer, or the like, to reduce wear on the contacted surface (19) of the door (8). The elastically deformable terminal element (18) can have a configuration which outwardly extends the configuration of the external surface of the second member (4). As shown in the example of FIGS. 2 and 8, the external surface of the second member (4) generally defines a square in cross section (as shown in the example of FIG. 2B) and the external surface of the elastically deformable terminal element (18) also defines a square in cross section (as shown in the example of FIG. 7) having generally the same external dimensions as the second member (4). However, other embodiments of the invention may include an elastically deformable terminal element (18) having configuration substantially dissimilar to the second member (4) depending upon the application. The elastically deformable terminal element (18) can be coupled to the second member (4) by configuring a portion to insert within the tubular portion (17) of the second member (4) (as shown in the example of FIG. 8) or can be coupled by insertion of the second member (4) into a sleeve portion of the elastically deformable terminal element (18); however, other methods of coupling the elastically deformable terminal element (18) to the outwardly extending end (9) of the second member (4) can be utilized.

Now referring primarily to FIGS. 2 and 8, embodiments of the invention can include a springing element (5) responsive to movement of the second member (4). The springing element (5) can be configured in any form sufficiently compressible in response to movement of the second member (4) to allow the desired amount of reciprocal telescopic movement of the second member (4). While particular embodiments of the springing element (5) can take the form of a coil spring (20) (as shown in the examples of FIGS. 2 and 8); other embodiments of the springing element (5) can take the form of an amount of elastomer having open cells or closed cells sufficient to allow compression and expansion corresponding to reciprocal telescopic movement of the second member (4). Other materials or constructional forms of the springing element (5) can be utilized which elastically compress in response to movement of the second member (4) allowing the outwardly extending end (9) to move in a first direction (21) upon engagement with a door (8) and in a second direction (22) in response to expansion of the springing element (5) toward the uncompressed configuration.

Figure 9:
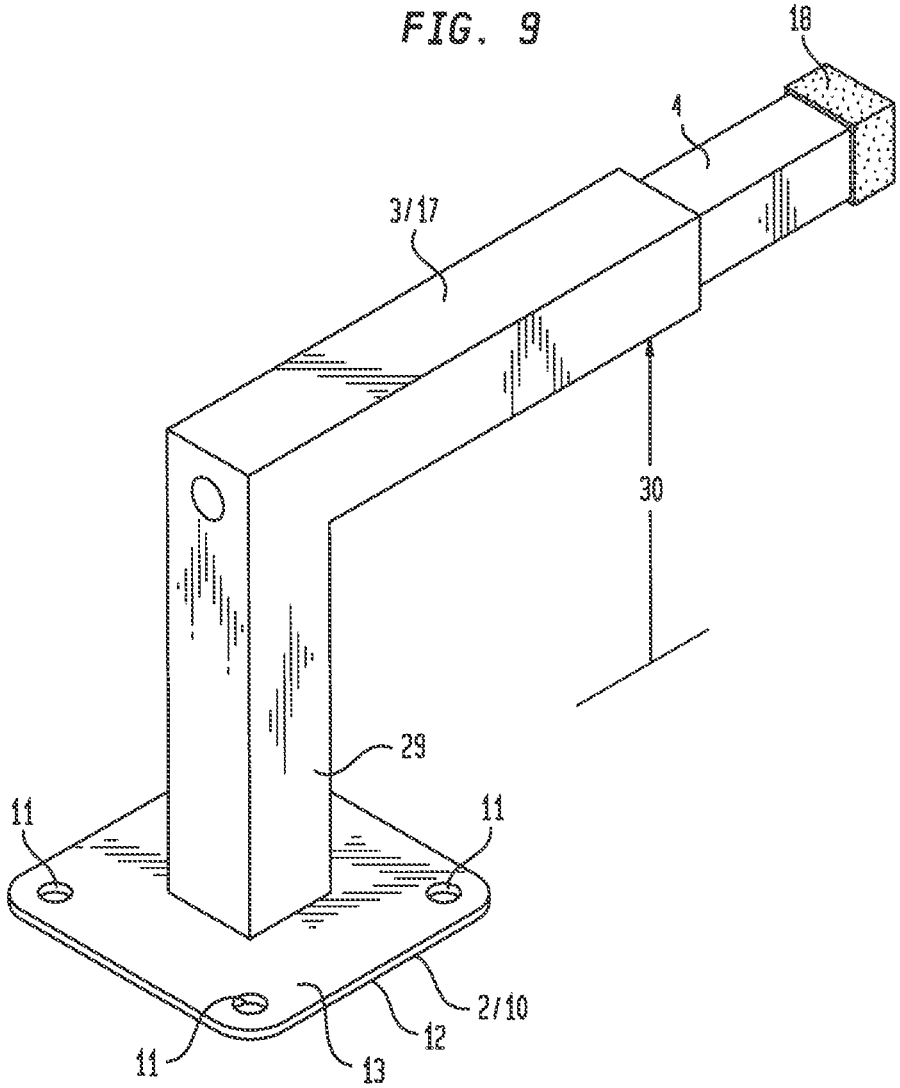
FIG. 9 is a perspective view of another particular embodiment of the inventive door stop having a third member disposed between a base and a first member to maintain the reciprocally telescopically engaged member at a height in relation to the base.

As to the particular embodiment shown in FIGS. 2 and 9, the first member (3) can take the form of a tubular element (17) having a closed end (23). The springing element (5) in the form of a coil spring (20) can be located inside the tubular element (17) with a first spring end (24) engaging the closed end (23) of the first member (3). The second member (4) can be reciprocally telescopically engaged inside of the tubular element (17) of the first member (3) to engage the second spring end (25). Forcible urging of the second member (4) against the second spring end (25) in a first direction (21) compresses the coil spring (20) and release of forcible urging allows the coil spring (20) to return toward the uncompressed condition generating movement of the second member (4) in a second direction (22).

Now referring primarily to FIG. 8, particular embodiments of the invention can further include a catch element (26) having a first catch part (27) and a second catch part (28) which engage to limit outward travel (22) of the second member (4) in relation to said first member (3). As shown in the example of FIG. 8, the catch element (26) can comprise a generally linear elongate member (30) having a first catch part (27) coupled to a first one (31) of the opposed. ends (31) (32). The second member (4) can be in the form of a closed end tube providing a second catch part (28) in the form of a closed end (33) having a pass through aperture (34). The pass through aperture (34) being sufficiently large to allow passage of the elongate member (30) but sufficiently small to prevent passage of the first catch part (27). The linear elongate member (30) can be passed through the pass through aperture (34) to engage the first catch part (27) with the second catch part (28) an further passed through the coil spring (20). Compression of the coil spring (20) between the closed end (23) of the first member and the closed end (33) of the second member (4) disengages the first catch part (27) and the second catch part (28) allowing the second one (32) of the opposed ends (31) (32) of the elongate member (30) to be coupled in fixed relation to the closed end (23) of the first member (3). Decompression of the coil spring (20) allows outward movement (22) of the second member (4) until the first catch part (27) engages the second catch part (28).

As to other embodiments, the first catch part (27) be coupled to the internal surface of the tubular portion (17) of the first member (3) and a second catch part (28) can be coupled to the external surface of the second member (4). The first and second catch parts (27) (28) can be located to engage thereby limiting travel of the second member (4).

Now referring primarily to FIG. 9, embodiments of the invention can further include a third member (29) disposed between the base (2) and the first member (3) to maintain location the first member (3) at a height (30) above the base (2). The third member (29), while shown as an elongate member having a substantially square cross section, can be of any configuration of sufficient dimension and strength to support the first member (3) during normal reciprocal telescoping engagement of the first member (3), as above described.

As can be easily understood from the foregoing, the basic concepts of the present invention may be embodied in a variety of ways. The invention involves numerous and varied embodiments of a reciprocally telescoping door stop and methods for making and using such door stops including the best mode.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "door stop" should be understood to encompass disclosure of the act of "door stopping"—whether explicitly discussed or not—and, conversely, were there effectively disclosure of the act of "door stopping", such a disclosure should be understood to encompass disclosure of a "door stop" and even a "means for door stopping." Such alternative terms for each element or step are to be understood to be explicitly included in the description.

In addition, as to each term used it should be understood that unless its utilization in this application is inconsistent with such interpretation, common dictionary definitions should be understood to included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Thus, the applicant(s) should be understood to claim at least: i) each of the reciprocally telescoping door stops herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to Which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

The invention claimed is:

1. A door stop, comprising:

a) a base configured to couple to a support surface;

b) a first tubular member having a first tubular member closed end opposite a flangeless first tubular member open end, said first tubular member fixedly coupled to said base;

c) a second tubular member having a flangeless second tubular member closed end including a pass through aperture, said second tubular member reciprocally telescopically engaged within said first tubular member, wherein said second tubular member is movable with respect to said base;

d) a springing element disposed within said first tubular member between said first tubular member closed end and said second tubular member closed end; and e) a catch element, comprising:

an elongate member fixedly coupled to said base, said elongate member having opposed first and second ends, said second end coupled to said first tubular member closed end of said first tubular member, said elongate member disposed axially within said first tubular member and extending through said pass through aperture of said second tubular member to dispose said first end within said second tubular member;

a catch part coupled to said first end of said elongate member, said catch part configured to engage said second tubular member closed end to limit outward travel of said second tubular member in relation to said first tubular member.

2. The door stop of claim 1, wherein said springing element has a location within said first tubular member which allows compression of said springing element upon inward travel of said second tubular member within said first tubular member.

3. The door stop of claim 2, wherein said springing element comprises a helical compression spring.

4. The door stop of claim 2, wherein said springing element has a location within said first tubular member which allows extension of said springing element to generate outward travel of said second tubular member.

5. The door stop of claim 1, further comprising a resiliently deformable terminal element coupled to an outwardly extending end of said second tubular member.

6. The door stop of claim 1, a third member disposed between said base and said first tubular member to maintain said first tubular member at a height above said base.

7. A method of stopping a door, comprising:

a) obtaining a door stop including:

i) a base configured to couple to a support surface;

ii) a first tubular member having a first tubular member closed end opposite a flangeless first tubular member open end, said first tubular member coupled to said base;

iii) a second tubular member having a flangeless second tubular member closed end including a pass through aperture, said second tubular member reciprocally telescopically engaged within said first tubular member, wherein said second tubular member is movable with respect to said base;

iv) a springing element disposed within said first tubular member between said first tubular member closed end and said second tubular member closed end; and v) a catch element, comprising:

an elongate member fixedly coupled to said base, said elongate member having opposed first and second ends, said second end coupled to said first tubular member closed end of said first tubular member, said elongate member disposed axially within said first tubular member and extending through said pass through aperture of said second tubular member to dispose said first end within said second tubular member;

a catch part coupled to said first end of said elongate member, said catch part configured to engage said second tubular member closed end to limit outward travel of said second tubular member in relation to said first tubular member; and b) positioning an outwardly extending end of said second tubular member in a travel path of said door at a location which allows said door moving in said travel path to engage said outwardly extending end of said second tubular member to generate inward travel of said second tubular member within said first tubular member, thereby sufficiently compressing said springing element to resist further movement of said door.

8. The method of claim 7, wherein fixing a position of said door stop further comprises:

a) maintaining said first tubular member in fixed relation to a said base; and b) securing said base to achieve positioning of said outwardly extending end of said second tubular member.

9. The method of claim 8, further comprising locating said outwardly extending end of said second tubular member at a height in relation to said base by disposing a third member between said base and said first tubular member.

10. The method of claim 9, further comprising extending said second tubular member reciprocally telescopically engaged within said first tubular member by decompression of said springing element acting on said second tubular member.

* * * * *